United States Patent [19]

Donahue

[11] Patent Number: 4,974,847

[45] Date of Patent: Dec. 4, 1990

[54] LOTTERY PICK MACHINE

[76] Inventor: Joseph F. Donahue, 1501 Roosevelt Ave., N12 Carteret, N.J. 07008

[21] Appl. No.: 160,842

[22] Filed: Feb. 24, 1988

[51] Int. Cl.[5] ..... A63F 9/00

[52] U.S. Cl. ..... 273/144 A

[58] Field of Search ..... 273/144 R, 144 A, 144 B

[56] References Cited

U.S. PATENT DOCUMENTS

| | | | |
|---|---|---|---|
| 1,655,296 | 1/1928 | Tapio | 273/144 A |
| 2,003,979 | 6/1935 | Skoric | 273/144 A |
| 2,668,717 | 2/1954 | Staub | 273/144 A |
| 2,731,268 | 1/1956 | Raizen | 273/144 A |
| 2,906,535 | 9/1959 | Hickey | 273/144 R X |
| 3,468,542 | 9/1969 | Ernst | 273/144 R |
| 4,813,676 | 3/1989 | Weatherspoon | 273/144 A |

FOREIGN PATENT DOCUMENTS

| | | | |
|---|---|---|---|
| 795869 | 1/1936 | France | 273/144 A |

*Primary Examiner*—Anton O. Oechsle

[57] ABSTRACT

A rotating drum is designed for mixing number balls within an enclosed container. The container has an entry port for the insertion of the balls and an exit port for the exit of the balls after they have been mixed and randomly selected. The machine may be used for any game or function that requires the mixing of numbers, but the main purpose is for the random selection of numbers for the various lottery games that are now popular around the country.

3 Claims, 1 Drawing Sheet

LOTTERY PICK MACHINE

BACKGROUND OF THE INVENTION

There are many devices or ways now to pick random numbers but most have drawbacks, limitations or are not done in similar way to the way the lottery numbers are actualy picked at the drawing. An example of this is the use of dice to select numbers, but this is limited in that the numbers selected can only range for two to twelve and you may get duplicate numbers which may or may not be of any use in some lotery games. Another way is spining wheels, however, they too can cause duplication and they don't perform the selection fuction the same way that the various states pick their winning numbers for the lottery. Thus the public has longed for a device that picks numbers randomly in a manner similar to that done by the states when they pick their winning number, but without the drawbacks or limitations of the existing machines now on the market.

SUMMARY OF THE INVENTION

It is an object of this invention to provide a device that similates the actual way the lottery numbers are picked by the various states that conduct lottery games.

It is a further object of this invention to provide such a device at a price that is reasonable and in such a form that the device is convient to use, store and move.

Still a further object of this device is to pick number randomly without the drawbacks of the present devices and without duplication unless said duplication is required or desired.

A still futher object of this device is to make the machine useable for many state lottery games as opposed to one particular state.

This and other objects are accomplished by an enclosed container of plastic or other light weight inexpensive material, being of circular, rectangular or any other enclosed shape. The enclosure contains a rotating housing within it. The enclosure also has an entry and exit port which may or may not be the same port for the insertion and exiting of the selected numbered balls. After the balls are inserted into the enclosure they proceed down a ramp into a housing capable of rotation. The ramp may be eliminated and the balls could be inserted into the housing directly if so desired. Once the ball are in the housing said housing is rotated by manual, mechanical electrical or any other well known means to mix the balls. The balls, while they are being mixed, exit the same port in the housing that they entered, but by means of a different ramp then when they entered. If one desires, a blocking means can be placed on the housing or the exit ramp so that the balls are only released from the rotating housing after it stops or only at certain times during the rotation. When the balls exit the housing and travel on the ramp they move toward the exit of the enclosure where they are picked up and read by the person using the device. The person using the machine then may record the ramdom selected numberss to aid them in the selection of their lottery numbers.

DESCRIPTION OF THE PREFERRED ENBODIMENT OF THE INVENTION

Figure 1:
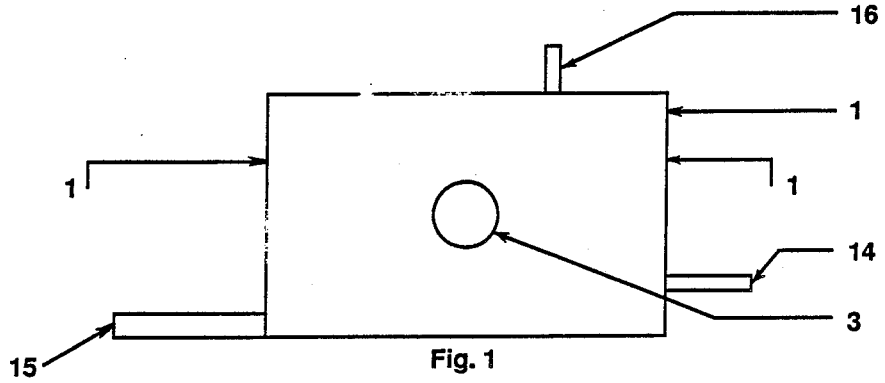
FIG. 1 is a side view of the front of the random number selection device of the invention.
Figure 2:
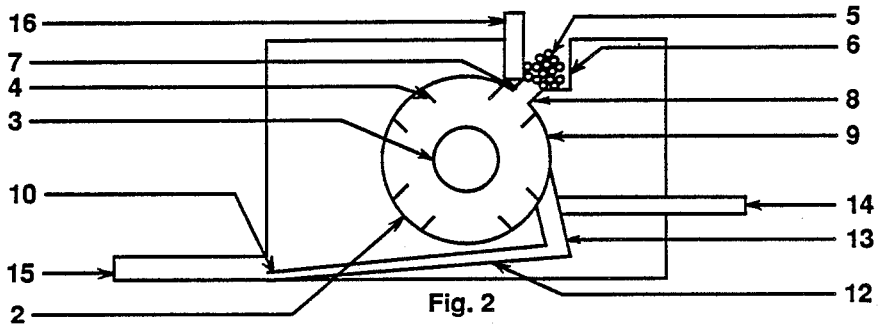
FIG. 2 is a section view of the front of the random number selection device of the invention through section 1—1.
Figure 3:
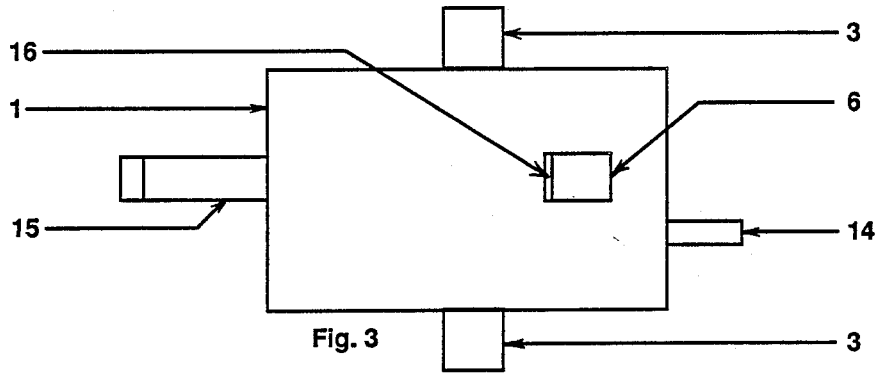
FIG. 3 is a top view of the random number selection device of the invention.
Figure 4:
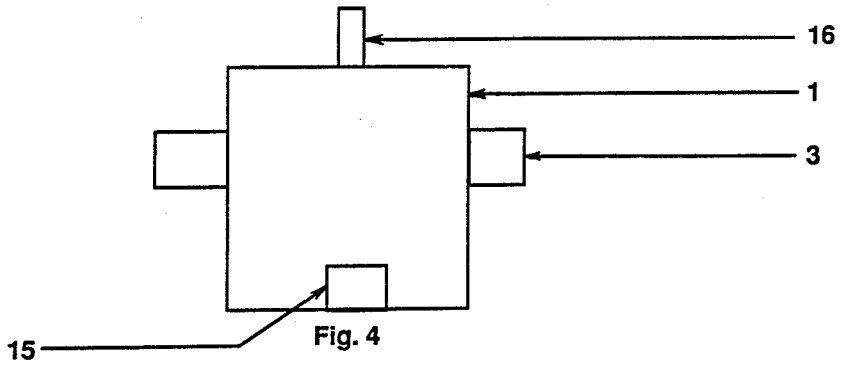
FIG. 4 is the side view of the random number selection device of the invention.

Referring now to FIG. 1 of the drawings, an enclosure 1, has contained within it a housing 2, which is capable of being rotated by means of shaft 3. Housing 2, is shown in the drawings as being of a cylindrical shape, but this is not critical. Contained within housing 2, are deflectors vanes 4, which aid in the mixing of balls 5. Balls 5 are number from 0 to any number to compensate for the various numbers that are used in the lottery games or whatever game one is doing or playing. The balls 5, maybe consecutively numbered or there may be duplication of numbers on different balls if the game or lottery calls for or allows duplication. After balls 5, are placed in chute 6, and blocking plate 16, is moved to open chute 6, ramp 7, allows the balls 5, to move toward entry-exist port 8, of housing 2. Ramp 7 may or may not be used, since the balls 5, can be feed directly into housing 2, if one so desires the device to operate that way. Lips 9, contained within housing 2, prevent balls 5, from exiting housing 2, en masse, in order to prevent any type of jaming of the balls 5, as they exit the housing 2, to proceed to exit 10, of the enclosure 1. Balls 5 after they are fully loaded into housing 2, are then rotated by means of shaft 3, which rotates housing 2. The means to move shaft 3, to rotate housing 2, may be manual, mechanical, electrical or any other means to cause movement of the shaft 3. Balls 5, either during rotation of housing 2, or after the rotation of housing 2, is stopped are allowed to exit housing 2, by way of entry-exit port 8, and travel on exit ramp 12, toward exit port 10. The entrance 13, to exit ramp 12, may or may not be blocked off by retainer door 14. The function of retained door 14, is to prevent balls 5 from exiting to ramp 12, before the user of the invention is ready for this exiting to begin.

The course that balls 5, follow once they enter into ramp 12, can vary as long as ramp 12, is such that the balls 5, cannot fall off of ramp 12, which would then prevent balls 5, from exiting enclosure 1, though port 10. Exit port 10, may or may not have a retaining selection holder 15. The selection holder merely holds ball 5, in the order that they exit enclosure 1, until the numbers on balls 5, can be read and recorded. After reading and recording of the numbers on ball 5, oone either reinserts the balls 5, back into chute 6, to again be mixed or puts the balls 5, into storage for later use.

The invention has been described with particular reference to the preferred embodiments, but it will be understood that variations and modifications within the spirit and scope of the invention may occur to those skilled in the art to which the invention pertains.

I claim:

1. A random number selection device comprising of an enclosure containing a rotating housing completely enclosed within the enclosure, the surface of the rotating housing that is adjacent to the enclosure having a continuous smooth surface, the enclosure is capable of accepting numbered balls through an entry means within the enclosure, the rotating housing also has an entry means to accept and store the multiple balls that entered the enclosure through its entry means, in addition said entry means of the housing also is an exit means for the balls that entered the houisng, adjacent to the housing is a ramp means for transporting the balls that leave the housing to an exit port of the enclosure.

2. The random number selection device of claim 1 wherein the rotating housing has internal lips near its exit means to prevent the numbered balls from exiting en masse.

3. The random number selection device of claim 1 wherein the rotating housing has vanes within said housing to aid in mixing the numbered balls.

* * * * *